US011167546B2

(12) United States Patent
Qiu et al.

(10) Patent No.: US 11,167,546 B2
(45) Date of Patent: Nov. 9, 2021

(54) INKJET PRINTING APPARATUS AND CONTROL METHOD THEREFOR

(71) Applicant: Hitachi Industrial Equipment Systems Co., Ltd., Tokyo (JP)

(72) Inventors: An Qiu, Tokyo (JP); Takashi Kawano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/642,238

(22) PCT Filed: Aug. 8, 2018

(86) PCT No.: PCT/JP2018/029789
§ 371 (c)(1),
(2) Date: Feb. 26, 2020

(87) PCT Pub. No.: WO2019/044441
PCT Pub. Date: Mar. 7, 2019

(65) Prior Publication Data

US 2020/0353747 A1 Nov. 12, 2020

(30) Foreign Application Priority Data

Aug. 31, 2017 (JP) ..... JP2017-167195

(51) Int. Cl.
*B41J 2/03* (2006.01)
*B41J 2/035* (2006.01)
*B41J 2/02* (2006.01)

(52) U.S. Cl.
CPC ..... *B41J 2/035* (2013.01); *B41J 2002/022* (2013.01)

(58) Field of Classification Search
CPC ..... B41J 2/035; B41J 2/025; B41J 2/08; B41J 2/095; B41J 2/12; B41J 2002/022;
(Continued)

(56) References Cited

U.S. PATENT DOCUMENTS

2003/0043239 A1 3/2003 Yamada et al.
2010/0073411 A1 3/2010 Moriai et al.
(Continued)

FOREIGN PATENT DOCUMENTS

EP 2 881 258 A1 6/2015
JP 7-81065 A 3/1995
(Continued)

OTHER PUBLICATIONS

International Search Report (PCT/ISA/210) issued in PCT Application No. PCT/JP2018/029789 dated Sep. 4, 2018 with English translation (four (4) pages).
(Continued)

*Primary Examiner* — Kristal Feggins
(74) *Attorney, Agent, or Firm* — Crowell & Moring LLP

(57) ABSTRACT

An ink jet recording apparatus includes a charging electrode that charges ink particles ejected from a nozzle, a deflecting electrode that deflects the ink particles charged by the charging electrode, an operating unit that inputs and sets printing conditions for performing the printing, and a control unit, and the control unit receives a moving distance in a direction in which a printing target is conveyed from the operating unit, calculates the number of non-printing particles on the basis of the moving distance, and performs control for changing to a dot pattern in which the number of non-printing particles are inserted.

7 Claims, 9 Drawing Sheets

(58) Field of Classification Search
CPC ..... B41J 2/085; B41J 2/13; B41J 2/075; B41J 2/105; B41J 2/115
See application file for complete search history.

(56) References Cited

U.S. PATENT DOCUMENTS

| | | | |
|---|---|---|---|
| 2013/0249984 | A1 | 9/2013 | Marcus et al. |
| 2015/0165761 | A1 | 6/2015 | Qiu et al. |

FOREIGN PATENT DOCUMENTS

| | | | |
|---|---|---|---|
| JP | 2001-63064 | A | 3/2001 |
| JP | 2002-1960 | A | 1/2002 |
| JP | 2014-24294 | A | 2/2014 |
| WO | WO 2008/102458 | A1 | 8/2008 |

OTHER PUBLICATIONS

Japanese-language Written Opinion (PCT/ISA/237) issued in PCT Application No. PCT/JP2018/029789 dated Sep. 4, 2018 (four (4) pages).
Extended European Search Report issued in European Application No. 18852671.9 dated Mar. 30, 2021 (10 pages).

INKJET PRINTING APPARATUS AND CONTROL METHOD THEREFOR

TECHNICAL FIELD

The present invention relates to an ink jet recording apparatus and a control method therefor, and particularly to a technique of reducing printing distortion in a traverse direction.

BACKGROUND ART

Patent Document 1 states that, in an ink jet recording apparatus that forms characters to be printed with dots of ink particles, vertically arranged data of dots arranged vertically along a direction in which the ink particles are deflected is detected for each column, and when there are continuous charged dots that are continuously charged on the basis of the vertical arrangement data, dots that are not used for printing in the same column are interposed between the continuous charged dots, so that printing distortion is reduced.

CITATION LIST

Patent Document

Patent Document 1: JP 2002-1960 A

SUMMARY OF THE INVENTION

Problems to be Solved by the Invention

The technique disclosed in Patent Document 1 is an effective means for the printing distortion in the vertical direction, but printing distortion in a traverse direction, for example, curved printing or the like is not considered. Therefore, in the technique disclosed in Patent Document 1, when there are continuously charged dots that are continuously charged, in a case in which a dot not used for printing in the same column is interposed between the continuously charged dots, a timing at which a charging voltage is applied changes unintentionally. In this case, it lands a timing different from a timing at which the original ink particles land, and there is a problem in that a difference in the landing time is a deviation in the traverse direction.

It is an object of the present invention to provide an ink jet recording apparatus with reduced printing distortion in the traverse direction and improved printing quality.

Solutions to Problems

As a preferred example of the present invention, an ink jet recording apparatus that performs printing of a dot matrix on a printing target through ink particles ejected from a nozzle includes a charging electrode that charges the ink particles ejected from the nozzle, a deflecting electrode that deflects the ink particles charged by the charging electrode, an operating unit that inputs and sets printing conditions for performing the printing, and a control unit, and the control unit receives a moving distance in a direction in which the printing target is conveyed from the operating unit, calculates the number of non-printing particles on the basis of the moving distance, and performs control for changing to a dot pattern in which the number of non-printing particles are inserted.

Effects of the Invention

According to the present invention, it is possible to provide an ink jet recording apparatus with reduced printing distortion in the traverse direction and improved printing quality.

MODE FOR CARRYING OUT THE INVENTION

Hereinafter, an exemplary embodiment will be described with reference to the appended drawings.

Figure 1:
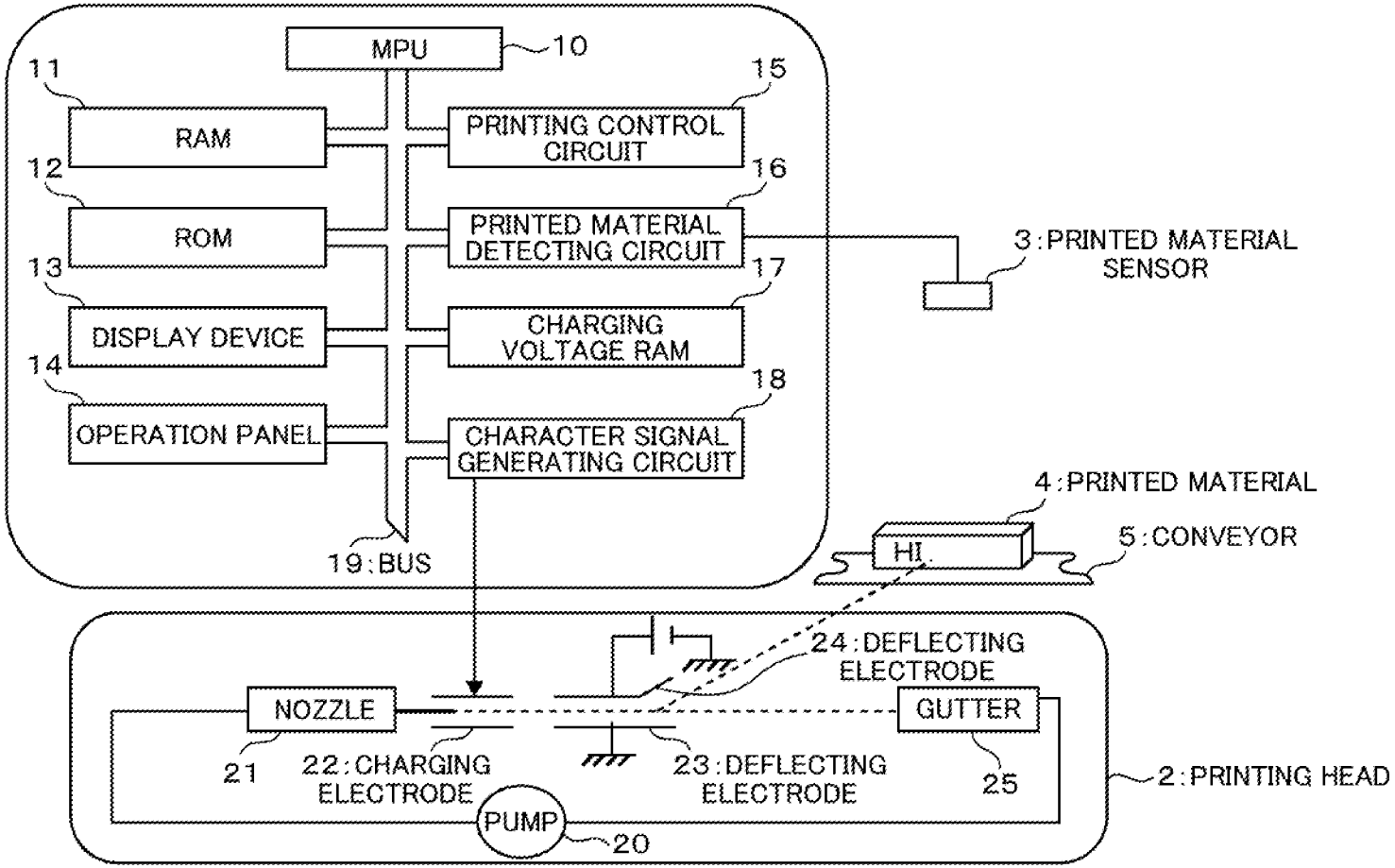
FIG. 1 is a diagram illustrating a configuration of an ink jet recording apparatus that is an embodiment.

FIG. 1 is a diagram illustrating a configuration of an ink jet recording apparatus in the present embodiment. A micro processing unit (MPU) 10 serving as a processing device, a random access memory (RAM) 11, a data storage unit 11, a read only memory (ROM) 12, a display device 13, an operation panel 14, a printing control circuit 15, a printed material detecting circuit 16, a charging voltage RAM 17, and a character signal generating circuit 18 are disposed. The respective blocks are connected to one another via a bus 19. A circulating unit includes a pump 20. A printing head 2 includes a nozzle 21, a charging electrode 22, a negative deflecting electrode 23, a positive deflecting electrode 24, and a gutter 25.

The MPU 10 is a so-called control unit that controls the ink jet recording apparatus. The RAM 11 is a volatile memory and temporarily stores data. The ROM 12 is a non-volatile memory that stores software for calculating a write start position or the like and data. The display device 13 displays input data, printing content, or the like. The operation panel 14 is an operating unit for inputting printing content data, printing conditions, or the like.

The printing content data includes, for example, a width of a printed material, a printing distance, a write position, a width of a printing character string, a character height setting value, a character to be printed, and the like. The printing distance is distance information indicating a distance from the printing head 2 to the printed material 4, and the character height setting value is character height information indicating a height of a character to be printed.

The printing control circuit 15 controls a printing operation of the ink jet recording apparatus. The printed material detecting circuit 16 detects the printed material 4 on the basis of a detection result of a printed material sensor 3. The charging voltage RAM 17 stores charging voltage data for charging the printing particles. The character signal generating circuit 18 functioning as a charging voltage generator converts printing content to be printed on the printed material 4 into a character signal. The pump 20 supplies ink to the nozzle 21.

The charging electrode 22 applies electric charges to the printing particles that are ejected from the nozzle 21 and become particles. The negative deflecting electrode 23 and the positive deflecting electrode 24 deflect the charged printing particles. The gutter 25 collects ink which is not used for printing. The printed material 4 is placed on a conveyor 5 that conveys the printed material 4. The conveyor 5 includes the printed material sensor 3 described above, and detects the printed material 4.

Next, an overview of a series of operations from an input of the printing content by the ink jet recording apparatus to completion of printing will be described. First, the printing content data is input by the operation panel 14. At this time, the printing content data is input from the operation panel 14 in accordance with an input instruction displayed on the display device 13. The input printing content data is stored in the RAM 11.

The printing content data stored in the RAM 11 is read out to the MPU 10. The MPU 10 generates the charging voltage data for charging the printing particles in accordance with the printing content data through a program stored in the ROM and stores the charging voltage data in the charging voltage RAM 17 via the bus 19.

The programs stored in the ROM 12 include a program for applying a non-printing charging voltage which is a charging voltage that does not jump over the gutter 25 to non-printing particles in a dot matrix for printing, a program for applying a non-printing charging voltage that does not jump over the gutter 25 to a plurality of non-printing particles to fly after final printing particles, and the like.

The nozzle 21 is supplied with the ink pressurized by the pump 20. An exciting voltage is applied to the nozzle 21, and a signal determined by the frequency of the exciting voltage is applied to the ink, and an ink column is ejected from the nozzle of the nozzle 21.

The ink column ejected from the nozzle 21 turns into particles in the charging electrode 22, and becomes printing particles, that is, ink particles. The printing particles used for printing receive negative charges and are deflected towards the positive deflecting electrode 24 by flying through an electric field formed by the positive deflecting electrode 24 and the negative deflecting electrode 23. Accordingly, the printing particles fly to the printed material 4 and adhere to and is printed on the printed material 4.

The printing particles with a large electric charge amount have a large deflection amount, while the printing particles with a small electric charge amount have a small deflection amount. The non-printing particles which are ink particles not used for printing are collected by the gutter 25 and supplied again to the nozzle 21 by the pump 20. Here, the occurrence of the curved printing will be described.

Figure 2:
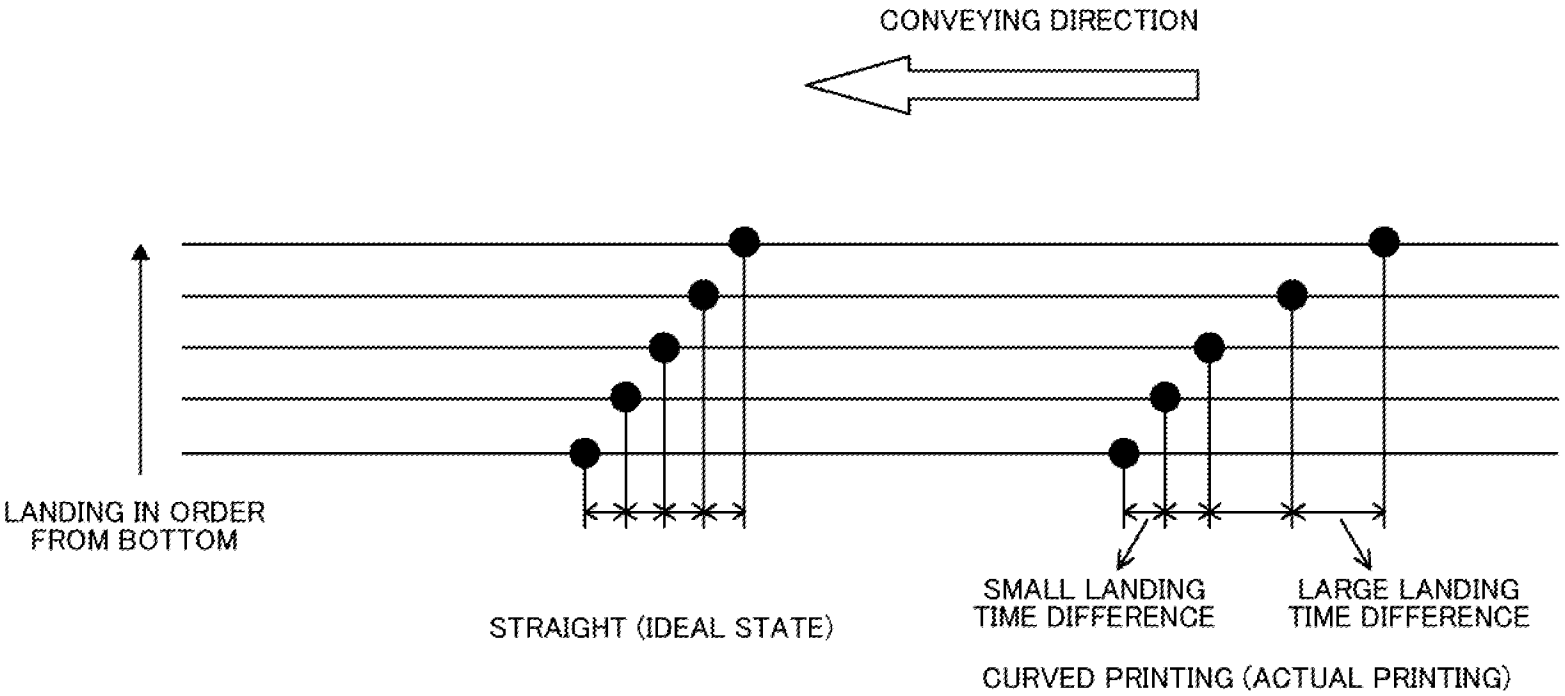
FIG. 2 is an explanatory diagram illustrating an example of the occurrence of curved printing in an ink jet recording apparatus.

FIG. 2 is an explanatory diagram illustrating an example of the occurrence of the curved printing in the ink jet recording apparatus. A horizontal axis indicates a landing time. In a case in which the printing particles is flown in order from the printing particles with the small electric charge amount to the printing particles with the largest electric charge amount, one vertical column is printed with five printing particles as illustrated in FIG. 2.

In the ink jet recording apparatus illustrated in FIG. 1, printing is performed while the printed material 4 is being moved by the conveyor 5. In a case in which printing is performed in order from the bottom, the particles fly in order from the printing particles with the small electric charge amount, that is, the printing particles with the shorter flight distance.

$$\text{Flight time} \times \text{Moving speed of printed material} = \text{Moving distance in traverse direction} \quad (1)$$

As can be seen from Formula (1), printing is inclined as the printed material 4 moves.

However, as the moving speed of the printed material 4 increases, the printing distance of the printing particles with a large deflection amount from the nozzle 21 to the printed material 4 increases, and the time taken until landing increases, and thus printing is curved as illustrated on the right side of FIG. 2. In this case, although the inclination of the printing is improved by adjusting the angle of the printing head 2, it is difficult to improve the bending of the printing.

Figure 3:
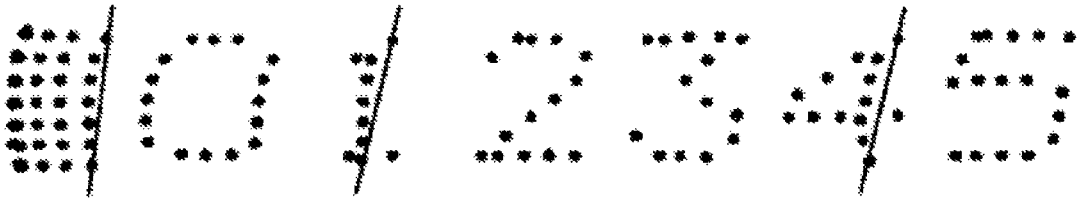
FIG. 3 is a diagram illustrating an example of a printing result when curved printing occurs.

FIG. 3 is an example of a printing result in a case in which the curved printing occurs when printing is performed while actually conveying the printed material at high speed. As illustrated in FIG. 3, when printing is performed while conveying the printed material at high speed, if there is a difference in a landing time between printing particles and printing particles in one column, the curved printing occurs.

In order to improve the above-described phenomenon, charging control (hereinafter referred to as "reverse scan printing") which landing is performed in order from the top was performed. In other words, the printing particles with a small electric charge amount are gradually charged from the printing particles with a large electric charge amount.

Figure 4:
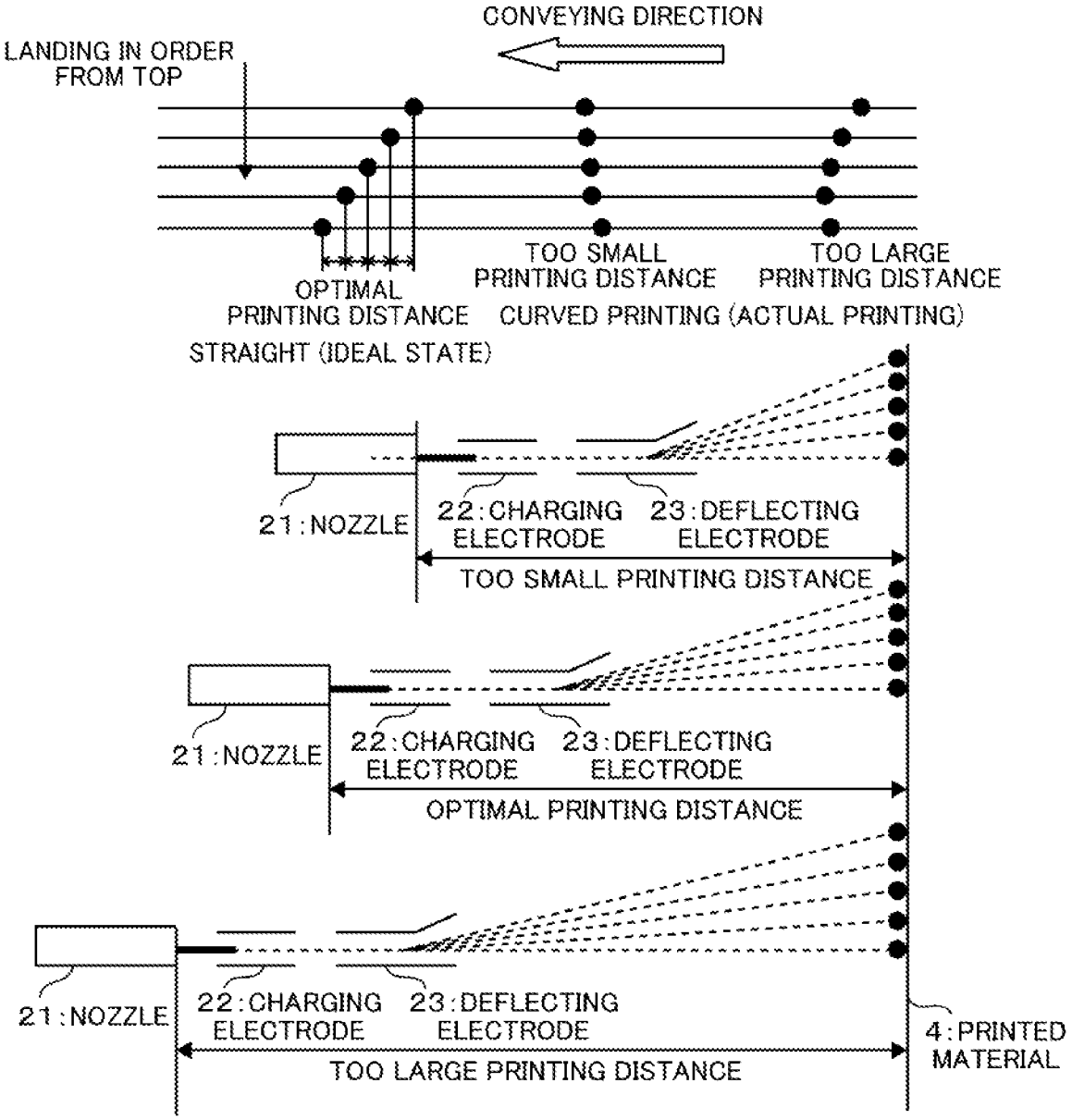
FIG. 4 is a diagram illustrating an example in which curved printing in reverse scan printing occurs.

FIG. 4 is a diagram illustrating an example in which curved printing occurs in reverse scan printing. As illustrated in FIG. 4, by causing the printing particles to fly in order from the printing particles with the longer flight distance, the bending of the printing is significantly improved as compared to the printing performed in order from the bottom. If the difference in the landing time between the printing particles and the printing particles in one column can be almost eliminated, it is possible to perform printing with a straight line with little bending.

As illustrated in FIG. 4, when the reverse scan printing is performed, it is desirable for an interval between the printing head and the non-printed material to have an optimal printing distance in order to match the flight time of the ink particles. However, depending on an actual production environment, there are cases in which it is difficult to adjust the optimal printing, and if the character size of the printing content changes, it also takes time and effort to adjust the printing distance.

Figure 5:
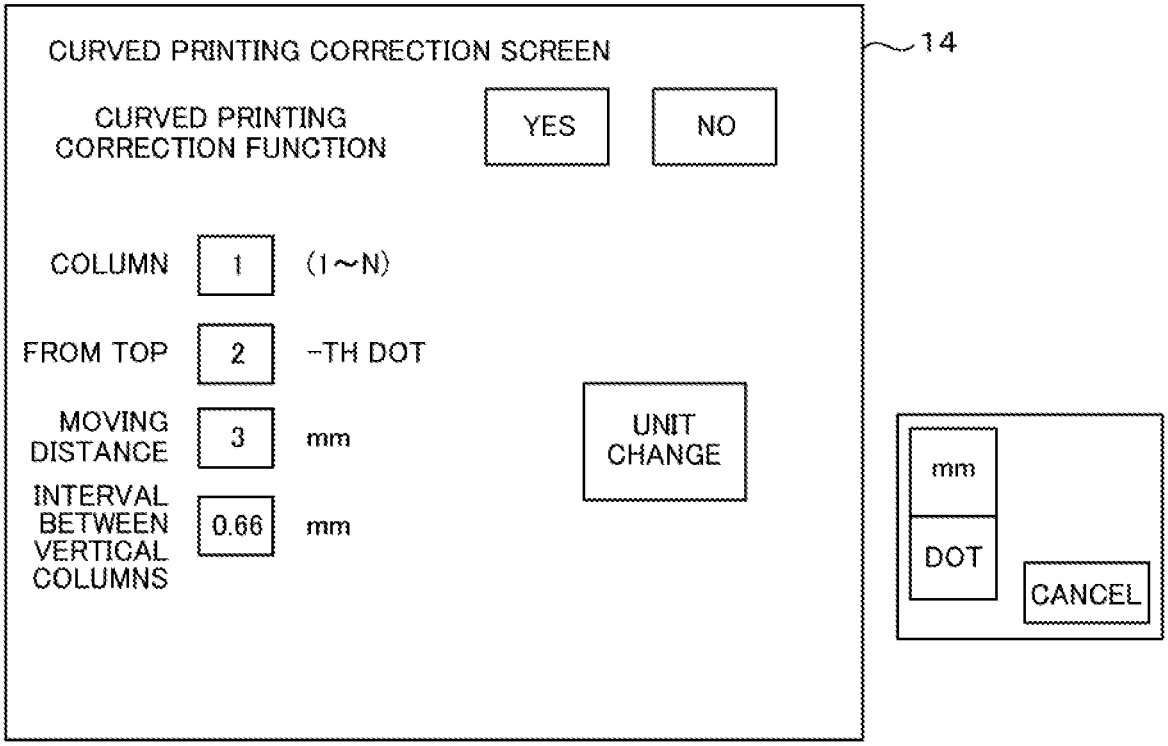
FIG. 5 is a diagram illustrating a function setting screen displayed on an operation panel.

A technique for reducing the above-described curved printing using the ink jet recording apparatus illustrated in FIG. 1 will be described below. FIG. 5 illustrates a function setting screen displayed on the touch input-type operation panel 14. In a curved printing correction screen, a "curved printing correction function" sets the need to reduce the bending of printing ("YES" is reducing the bending). "Column" indicates an area designating a column in which the bending of printing is to be corrected among vertical columns perpendicular to the conveying direction in the dot matrix. "From the top" indicates an area designating a number of a dot from the top in which the bending of printing is corrected in the designated column.

"MOVING DISTANCE" indicates an area designating a distance by which it is desired to move a position of a printing dot in order to correct the bending of printing. "DISTANCE BETWEEN VERTICAL COLUMNS" indicates an area designating a distance between vertical columns of first printed ink particles and last printed ink particles in each column. "UNIT CHANGE" is a function used to change a unit of a distance of the ink particles, and if the "UNIT CHANGE" area is selected, the function setting screen illustrated on the right thereof is displayed, so that it is possible to select a value to be designated in units of distances or in units of dots using the screen.

Figure 6:
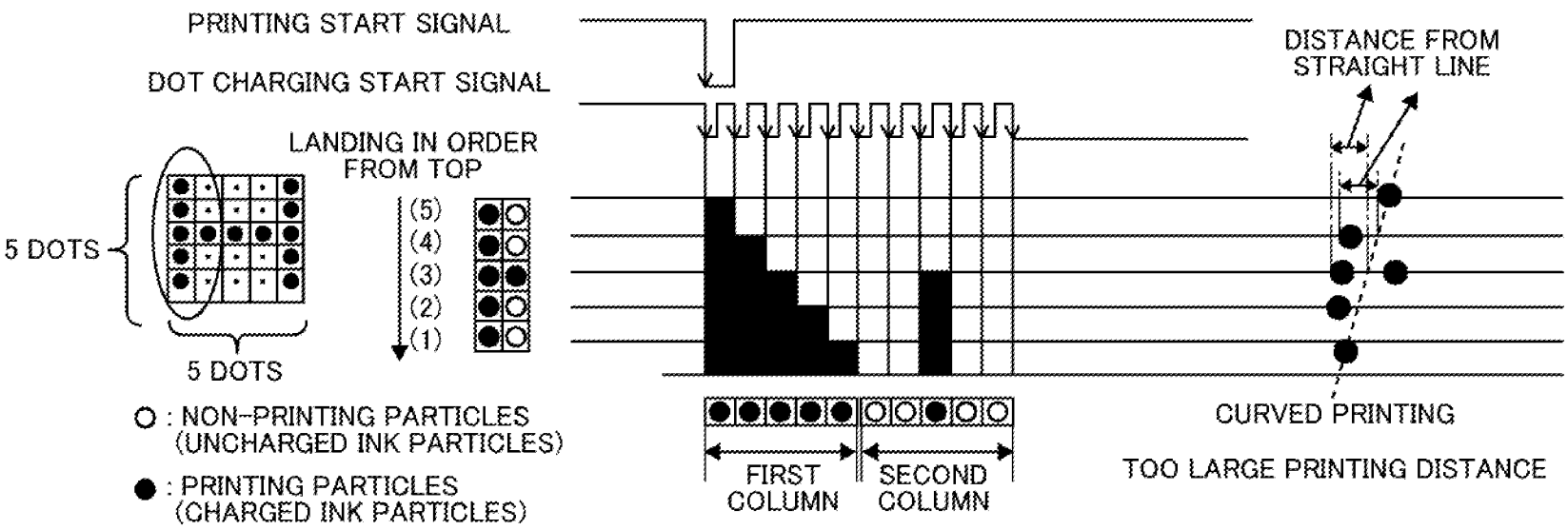
FIG. 6 is an explanatory diagram illustrating an example of reverse scan printing as a comparative example.

FIG. 6 is an explanatory diagram illustrating an example of reverse scan printing of a related art in the ink jet recording apparatus of FIG. 1 as a comparative example to the present embodiment. FIG. 6 illustrates an example in which a character "H" is printed, for example, by a dot matrix for printing of font 5 (horizontal)×5 (vertical). In the dot matrix for printing, black circles indicate printing particles, and white circles indicate non-printing particles that are not printed.

As the printing order, printing is performed in order from the top to the bottom of a dot matrix for printing of one vertical column arranged in the leftmost column in the dot matrix for printing. If the printing of one vertical column is completed, printing is performed in order from the top to the bottom of a dot matrix for printing of one vertical column positioned on the right side of one printed vertical column. By repeating this operation, printing of font 5×5 is performed.

As illustrated by a relation between a dot pattern staircase wave (vertical axis) and a printing time (horizontal axis), when the printing particles are charged, the ink particles (5), (4), (3), (2), and (1) printed in a first column are charged in order. At this time, the electric charge amount of the respective ink particles are ((5)→Q5), ((4)→Q4), ((3)→Q3), ((2)→Q2), and ((1)→Q1).

Similarly, the ink particles in a second column are charged in the order of (5), (4), (3), (2), and (1). An electric charge amount of a printing dot particle (3) is Q3. Here, five ink particle including uncharged ink particles that are not used for printing are used in each vertical column. As described above, when the printing distance is large, the curved printing occurs even if the reverse scan printing is performed.

Figure 7:
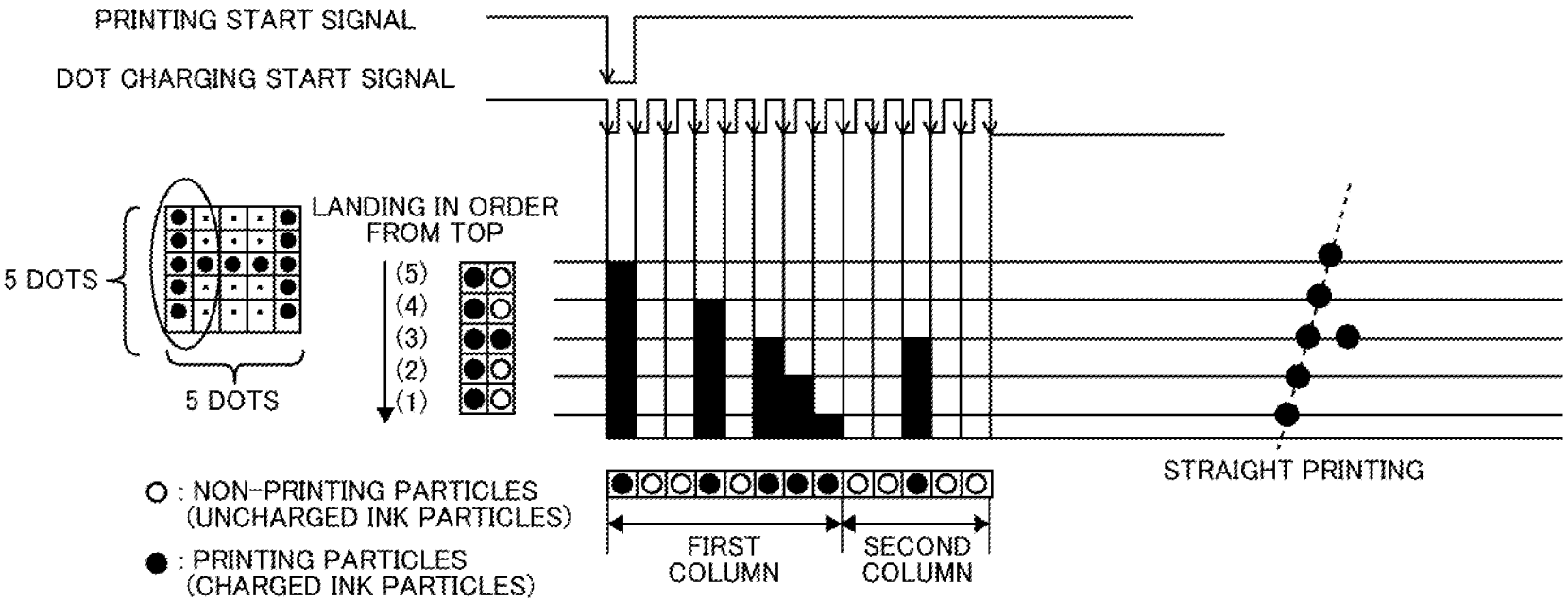
FIG. 7 is an explanatory diagram illustrating an example of reverse scan printing of the present embodiment.

FIG. 7 is an explanatory diagram illustrating an example of reverse scan printing of the present embodiment. Similarly to FIG. 6, a relation between the dot pattern staircase wave (vertical axis) and the printing time (horizontal axis) is also illustrated. As illustrated in FIG. 6, when the printing distance is large, the reverse scan printing is performed, and the distance in the conveying direction between the first printed ink particles and the last printed ink particles in the vertical column occurs, and the curved printing occurs. The number of non-printing particles to be inserted is calculated on the basis of the moving distance. The description will proceed with a 5×5 dot pattern.

First, it is possible to calculate a necessary time per one-column printing from the number of ink particles generated per second.

$$\text{Generation time of ink particles} = \text{Time (1 s)}/\text{Exciting frequency (75.4 kHz)} = 13.25\ \mu s \quad (2)$$

A time per one-column printing is calculated from the number of dots in one column by Formula (3).

$$\text{Printing time of one column} = \text{Generation time of ink particles} \times (\text{Number of dots in one column}) \quad (3)$$

The printing speed can be calculated using the printing time of one column and the interval between the vertical columns set by the operation panel 14.

$$\text{Printing speed} = \text{Interval between vertical columns}/\text{Printing time per column} \quad (4)$$

Then, the number of inserted non-printing particles can be calculated from the calculated printing speed and the moving distance input by the operation panel 14 by Formula (5).

$$\text{Number of inserted non-printing particles} = (\text{Moving distance}/\text{Printing speed})/\text{Generation time of ink particles} \quad (5)$$

Figure 8:
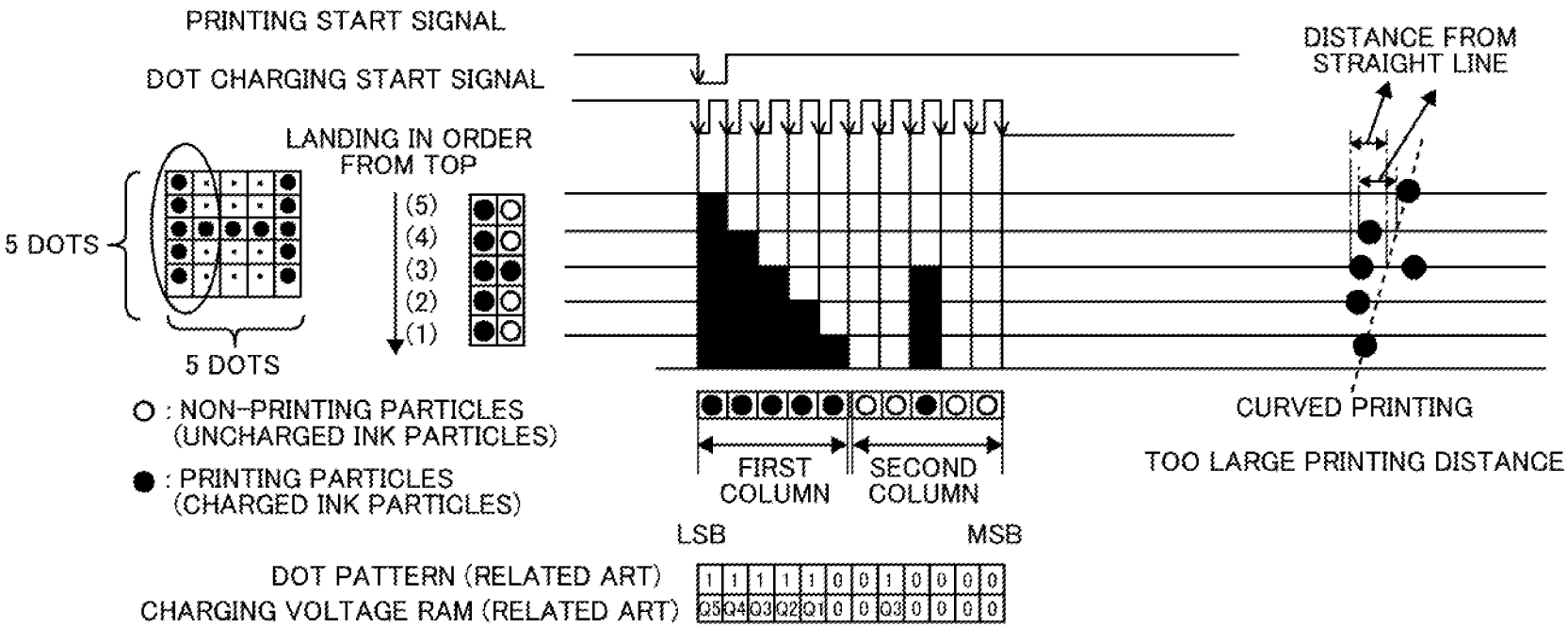
FIG. 8 is a diagram illustrating a relation between a staircase wave and a printing time of a dot pattern as a comparative example.
Figure 9:
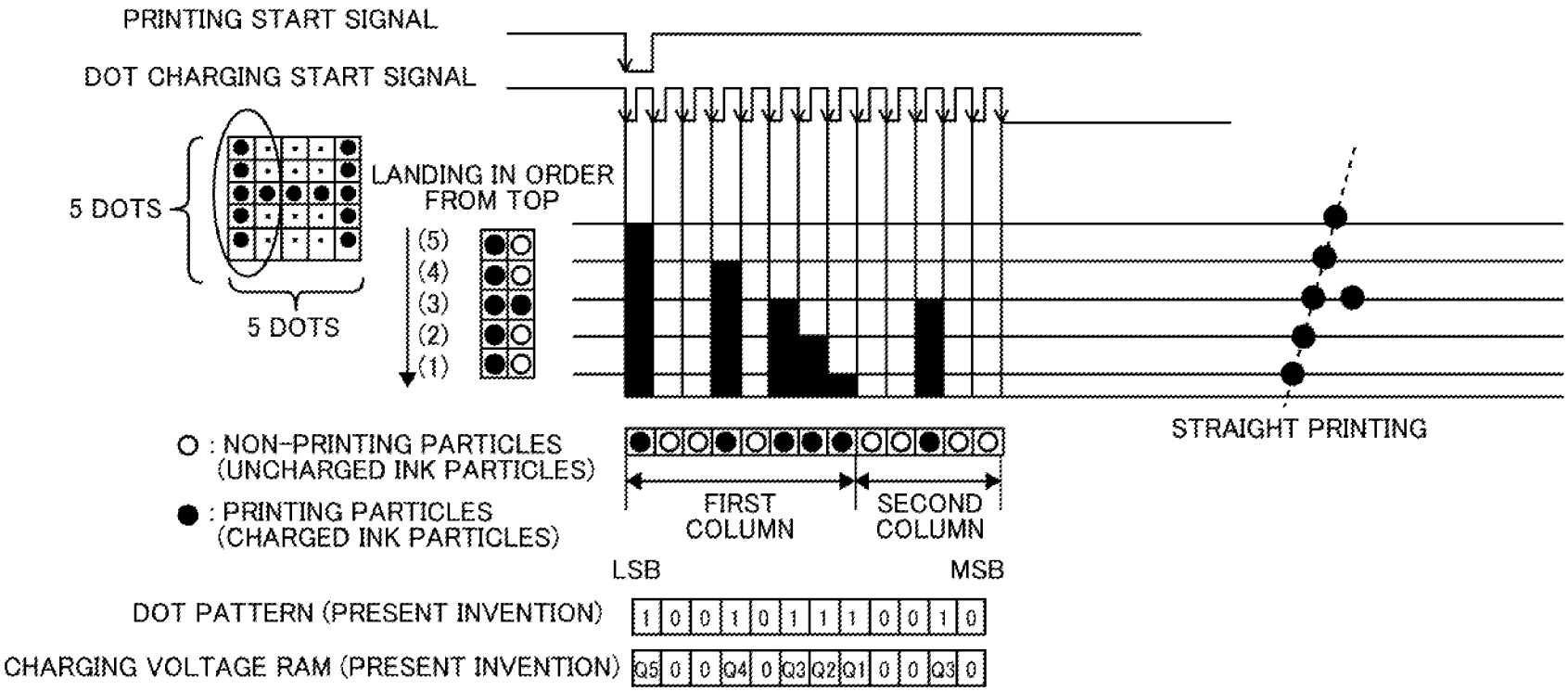
FIG. 9 is a diagram illustrating a relation between a staircase wave and a printing time of a dot pattern in an embodiment.

Next, a control algorithm will be described with reference to FIGS. 9 and 10. FIG. 8 is a diagram illustrating a relation between a dot pattern staircase wave (vertical axis) and a printing time (horizontal axis) as a comparative example to the present embodiment. FIG. 9 is a diagram illustrating a relation between a dot pattern staircase wave and a printing time in the embodiment. Here, the dot pattern is a pattern temporally indicating whether each ink particle is charged or uncharged. If charged, it is configured with 1; and if not charged, it is configured with 0. If charged, each charge amount takes a value proportional to the vertical axis in FIG. 8. It becomes 0 when the non-printing particles are inserted. The non-printing particles are collected by the gutter and do not contribute to the printing of dots in the dot matrix.

Using the program stored in the ROM 12, the charging voltage data for charging the printing particles is generated in accordance with the printing content data, and the charging voltage necessary for the dots that need to be charged is generated and stored in the charging voltage RAM 17. Actually, when printing is performed, the character signal generating circuit 18 reads the charging voltage data in order from the beginning of the charging voltage RAM 17 in accordance with to a control signal at a timing such as a printing start signal or a dot charging start signal from the printing control circuit, and applies the voltage to the charging electrode so that the ink particles are charged.

Here, in the comparative example, the electric charge amount of each dot is stored in each table of the charging voltage RAM 17. As illustrated in FIG. 8, the electric charge amount 0 is stored in the table corresponding to the non-charged dots. On the other hand, in the present embodiment illustrated in FIG. 9, the charging voltage RAM 17 stores only the electric charge amounts of the dots to be charged (other than 0) in association with the dot pattern. For dots into which the non-printing particles are to be inserted, 0 is stored in the corresponding table of charging voltage RAM 17.

Figure 10:
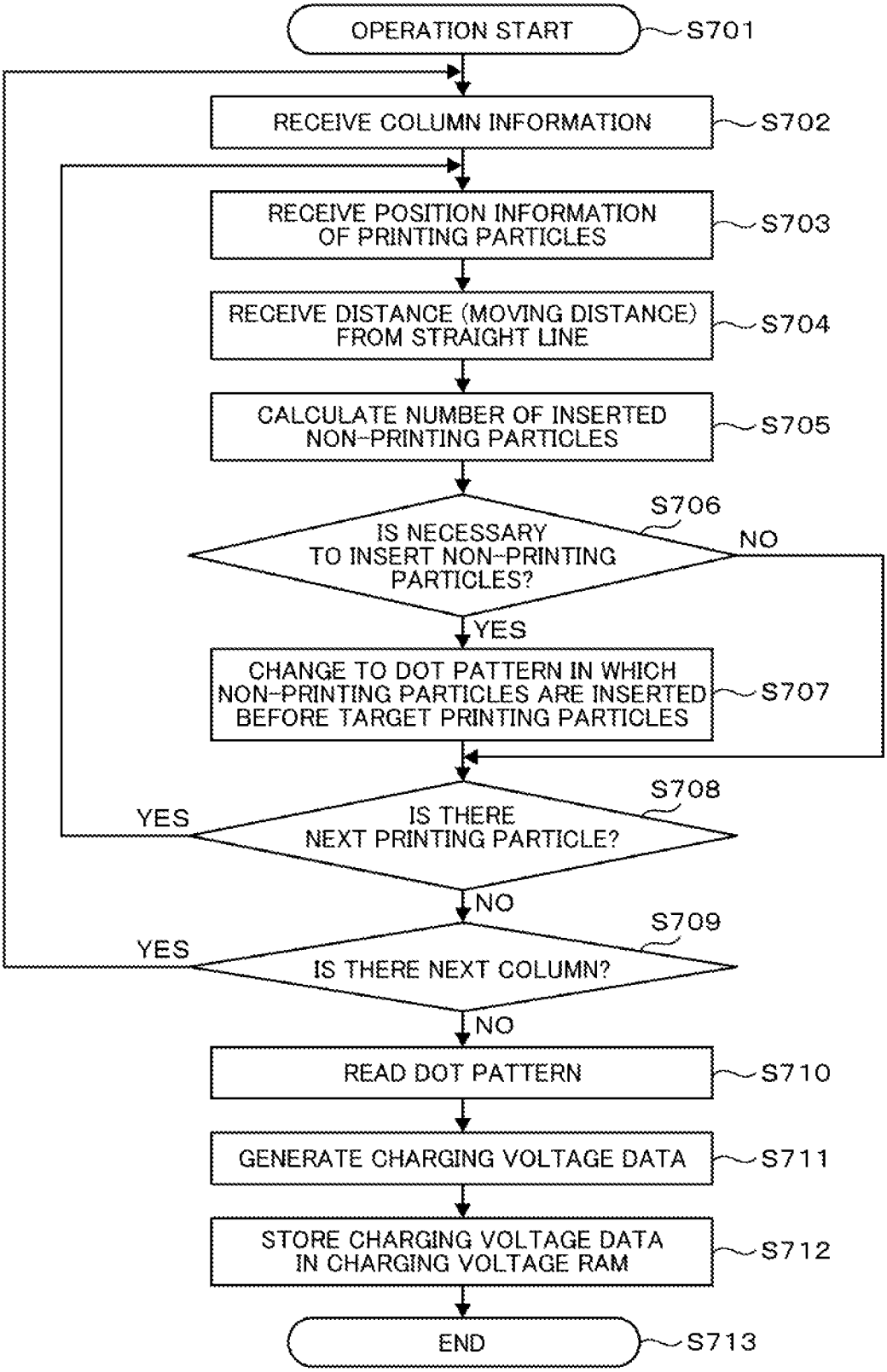
FIG. 10 is a diagram illustrating a processing flow regarding control for inserting non-printing particles for each column.

FIG. 10 is a diagram illustrating a flow chart of a control-related process in which the non-printing particles are inserted before the printing particles designated for each column. It is a dot pattern change program stored in the ROM 12 of FIG. 1, and the MPU 10 reads and executes the program.

After the operation starts (S701), designation of column information is received (S702). Here, the column information is a value of a column input by the operation panel 14.

Then, the position information of the printing particles in the column is received. The position information is information indicating a number of a printing particle from the top input by the operation panel 14 (S703).

Thereafter, a value of the moving distance is received by inputting a value of the moving distance between the printing particles and a straight line having no curved printing in the conveying direction (S704). The value of the moving distance is a value input by the operation panel 14 as the value of the distance in the traverse direction deviated from the straight line in order for correction after actually measuring from the printed printing result (referred to as a process of performing first printing) by the user or the like.

The number of inserted non-printing particles before the corresponding printing particles is calculated from the above information (S705). Then, the user is given an opportunity to determine whether or not the non-printing particles are inserted and asked to input that determination (S706). In a case in which the non-printing particles are inserted, it is changed to the dot pattern in which as many non-printing particles as the number of inserted non-printing particles are inserted before the printing particles designated by the operation panel (S707).

Thereafter, for example, it is displayed on the operation panel (not illustrated) so that the user is urged to determine whether or not there are next printing particle, and the user's determination is received (S708). In a case in which the non-printing particles are not inserted in S706, information indicating it is indicated on the operation panel or the like (not illustrated), the user is urged to determine whether there is a printing particle to be subjected to next curved printing correction through the operation panel or the like (not illustrated), and the determination is received (S708). In a case in which it is indicated that there is a next printing particle, the process returns to step (S703) of receiving the position information of the printing particles. In a case in which it is indicated that there is no next printing particle, it is urged to determine whether or not there is next column information through the operation panel or the like (not illustrated), and the determination is received (S709).

In a case in which the user's determination indicating that there is next column information is received, it returns to control for reading the column information (S702). In a case in which the user's determination indicating that there is no next column information is received, the latest dot pattern is read (S710). Thereafter, the charging voltage data is generated from the latest dot pattern (S711). The charging voltage data is stored in the charging voltage RAM 17 (S712), and the process ends (S713).

As the processing flow of FIG. 10 is executed, the printing is controlled using the charging voltage RAM 17 storing the charging voltage data generated from the changed dot pattern, and thus it is possible to correct the printing deviation in the traverse direction and to improve the printing quality.

REFERENCE SIGNS LIST

21 Nozzle
22 Charging electrode
23 Negative deflecting electrode
24 Positive deflecting electrode
25 Gutter
14 Operation panel

The invention claimed is:

1. An ink jet recording apparatus that performs printing of a dot matrix on a printing target through ink particles ejected from a nozzle, comprising:

a charging electrode that charges the ink particles ejected from the nozzle;

a deflecting electrode that deflects the ink particles charged by the charging electrode;

an operating unit that inputs and sets printing conditions for performing the printing; and a control unit, wherein the control unit is programmed to receive a moving distance in a direction in which the printing target is conveyed from the operating unit, calculate the number of non-printing particles on the basis of the moving distance, and perform control for changing to a dot pattern in which the number of non-printing particles are inserted.

2. The ink jet recording apparatus according to claim 1, wherein designation of a column of dots in the dot matrix to be subject to curved printing correction and a position of the dot in the column is received from the operating unit.

3. The ink jet recording apparatus according to claim 2, wherein an input of an interval of the column in a vertical direction of the dot matrix is received from the operating unit, and a printing speed is calculated on the basis of the interval of the column.

4. The ink jet recording apparatus according to claim 3, wherein the control unit calculates the number of non-printing particles to be inserted on the basis of the moving distance and the printing speed.

5. The ink jet recording apparatus according to claim 4, wherein the control unit generates a dot pattern in which the calculated number of non-printing particles is inserted before the designated position of the dot, and stores charging voltage data corresponding to the dot pattern in which the dot in which the number of non-printing particles is inserted is uncharged in a storage unit.

6. The ink jet recording apparatus according to claim 5, wherein the printing is performed by applying the charging voltage data to the charging electrode so that a character signal generating unit causes printing particles to fly in order from printing particles with a large electric charge amount to printing particles with a small electric charge amount on the basis of the charging voltage stored in the storage unit.

7. A control method for an ink jet recording apparatus that performs printing of a dot matrix on a printing target through ink particles ejected from a nozzle, the ink jet recording apparatus including a charging electrode that charges the ink particles ejected from the nozzle, a deflecting electrode that deflects the ink particles charged by the charging electrode, an operating unit that inputs and sets printing conditions for performing the printing; and a control unit programmed to control the control method, the control method comprising:

a step of applying charging voltage data based on a first dot pattern to the charging electrode to perform first printing on the printing target;

a step of receiving a moving distance for correcting deviation of a dot in the first printing step in a direction in which the printing target is conveyed from the operating unit;

a step of calculating the number of non-printing particles on the basis of the moving distance; and a step of performing control for changing the first dot pattern to a dot pattern in which the number of non-printing particles is inserted.

* * * * *